US007626566B2

(12) United States Patent
Huang

(10) Patent No.: US 7,626,566 B2
(45) Date of Patent: Dec. 1, 2009

(54) APPARATUS FOR ADJUSTING BRIGHTNESS AND METHOD OF THE SAME

(75) Inventor: Chi-Pao Huang, Taoyuan (TW)

(73) Assignee: Qisda Corporation, Taoyuan County (TW)

( * ) Notice: Subject to any disclaimer, the term of this patent is extended or adjusted under 35 U.S.C. 154(b) by 644 days.

(21) Appl. No.: 11/416,329

(22) Filed: May 2, 2006

(65) Prior Publication Data

US 2006/0257134 A1 Nov. 16, 2006

(30) Foreign Application Priority Data

May 13, 2005 (TW) ..... 94115705 A

(51) Int. Cl.
*G09G 3/30* (2006.01)

(52) U.S. Cl. ..... 345/77; 348/362

(58) Field of Classification Search ..... 345/77, 345/87, 89, 207, 690–692; 348/362
See application file for complete search history.

(56) References Cited

U.S. PATENT DOCUMENTS 6,870,529 B1 * 3/2005 Davis ..... 345/207
7,095,392 B2 * 8/2006 Lin ..... 345/87
2004/0119877 A1 * 6/2004 Shinozaki ..... 348/362

FOREIGN PATENT DOCUMENTS

TW 200207 2/1993

* cited by examiner

*Primary Examiner*—Amare Mengistu
*Assistant Examiner*—Yuk Chow

(57) ABSTRACT

In a display system, an inputted video sequence is displayed with an initial brightness at a first time and corresponding to a present control signal level and further displayed with a decayed brightness at a second time before adjustment. An apparatus, used for adjusting the brightness of the inputted video sequence, includes an input unit, a counter, a controller, and a brightness control unit. The input unit is used for inputting the present control signal level. The counter is used for counting time and outputting a notification signal at the second time. The controller is used for receiving the present control signal level and the notification signal and accordingly generating a present compensating parameter. The brightness control unit is used for receiving the present compensating parameter and generating an adjusted control signal level to adjust the brightness of the inputted video sequence from the decayed brightness to the initial brightness.

10 Claims, 5 Drawing Sheets

160a

| BR(cd/m$^2$) T(hr) CSL(Amp) | $T_1$=0 | $T_2$=1000 | $T_3$=2000 | $T_4$=3000 | $T_5$=4000 |
|---|---|---|---|---|---|
| 2 | 50 | 45 | 35 | 20 | 10 |
| 4 | 100 | 50 | 45 | 35 | 20 |
| 6 | 125 | 100 | 50 | 45 | 35 |
| 8 | 200 | 125 | 100 | 50 | 45 |
| 10 | 300 | 200 | 125 | 100 | 50 |

FIG. 4

160b

| CP / DBR / IBR | 45 | 35 | 20 | 10 |
|---|---|---|---|---|
| 50 | 2 | 4 | 6 | 8 |
| CP / DBR / IBR | 50 | 45 | 35 | 20 |
| 100 | 2 | 4 | 6 | 8 |
| CP / DBR / IBR | 100 | 50 | 45 | 35 |
| 125 | 2 | 4 | 6 | 8 |
| CP / DBR / IBR | 125 | 100 | 50 | 45 |
| 200 | 2 | 4 | 6 | 8 |
| CP / DBR / IBR | 200 | 125 | 100 | 50 |
| 300 | 2 | 4 | 6 | 8 |

FIG. 5

APPARATUS FOR ADJUSTING BRIGHTNESS AND METHOD OF THE SAME

BACKGROUND OF THE INVENTION

1. Field of the Invention

The invention relates to an apparatus and the method thereof applied in a display system for adjusting the brightness of an inputted video sequence when the display system is used for a span of time.

2. Description of the Prior Art

Referring to FIGS. 1 and 2, FIG. 1 is a diagram illustrating the relationship between the brightness of a conventional display system and time. FIG. 2 is a diagram illustrating the relationship between the brightness of the conventional display system and the control signal levels. Based on different specifications of the light sources, the brightness decay curve shown in FIG. 1 may have various types, and the brightness variation curve shown in FIG. 2 may also have various types. The control signal level can be a current signal, a voltage signal, or a pulse width modulation (PWM) signal. The flat panel display is the main display system in the future. However, when the conventional display system is used for a span of time, the brightness of the displayed image will decay gradually, as shown in FIG. 1. If a user desires to watch images with a fixed brightness any time, he/she always needs to manually adjust the brightness from decayed brightness to the original brightness after a span of time. Under some conditions, the display system is usually positioned at a specific place, and it's extremely inconvenient for the user to manually adjust the brightness of the display system.

In the prior art, there are also some display systems utilizing a sensor to directly detect the brightness, so as to automatically adjust the brightness. However, these display systems always need more accurate sensor, and the cost will also increase a lot due to the sensor.

Therefore, the objective of the invention is to provide an apparatus and the method thereof for adjusting the brightness of an inputted video sequence, so as to solve the aforementioned problems.

SUMMARY OF THE INVENTION

An objective of the invention is to provide an apparatus and the method thereof for adjusting the brightness of an inputted video sequence when a display system is used for a span of time. Since the invention doesn't install any sensor, the cost of the invention is less than the prior art.

In a display system, an inputted video sequence is displayed with an initial brightness at a first time and corresponding to a present control signal level and, before adjustment, further displayed with a decayed brightness at a second time after the first time. According to a preferred embodiment, an apparatus of the invention is used for adjusting the brightness of the inputted video sequence. The apparatus comprises an input unit, a counter, a controller, and a brightness control unit. The input unit is used for inputting the present control signal level. The counter is used for counting time and outputting a notification signal at the second time. The controller is respectively coupled to the input unit and the counter, and used for receiving the present control signal level and the notification signal. According to the present control signal level, the first time, and the second time, the controller further generates a present compensating parameter. The brightness control unit is coupled to the controller and used for receiving the present compensating parameter. According to the present compensating parameter, the brightness control unit further adjusts the present control signal level and generates an adjusted control signal level to adjust the brightness of the inputted video sequence at the second time from the decayed brightness to the initial brightness. By setting the first time and the second time, how long the control signal level should be adjusted can be controlled. According to the apparatus and the method thereof of the invention, when the display system is used for a predetermined span of time, the controller will automatically adjust the control signal level to adjust the brightness of the inputted video sequence from the decayed brightness to the original brightness set by the user. Accordingly, the brightness of the display system can be maintained by simple control without any sensor, and then the cost will be reduced.

The advantage and spirit of the invention may be understood by the following recitations together with the appended drawings.

BRIEF DESCRIPTION OF THE APPENDED DRAWINGS

FIG. 4 is a schematic diagram illustrating the first look-up table shown in FIG. 3.

FIG. 5 is a schematic diagram illustrating the second look-up table shown in FIG. 3.

DETAILED DESCRIPTION OF THE INVENTION

Figure 1:
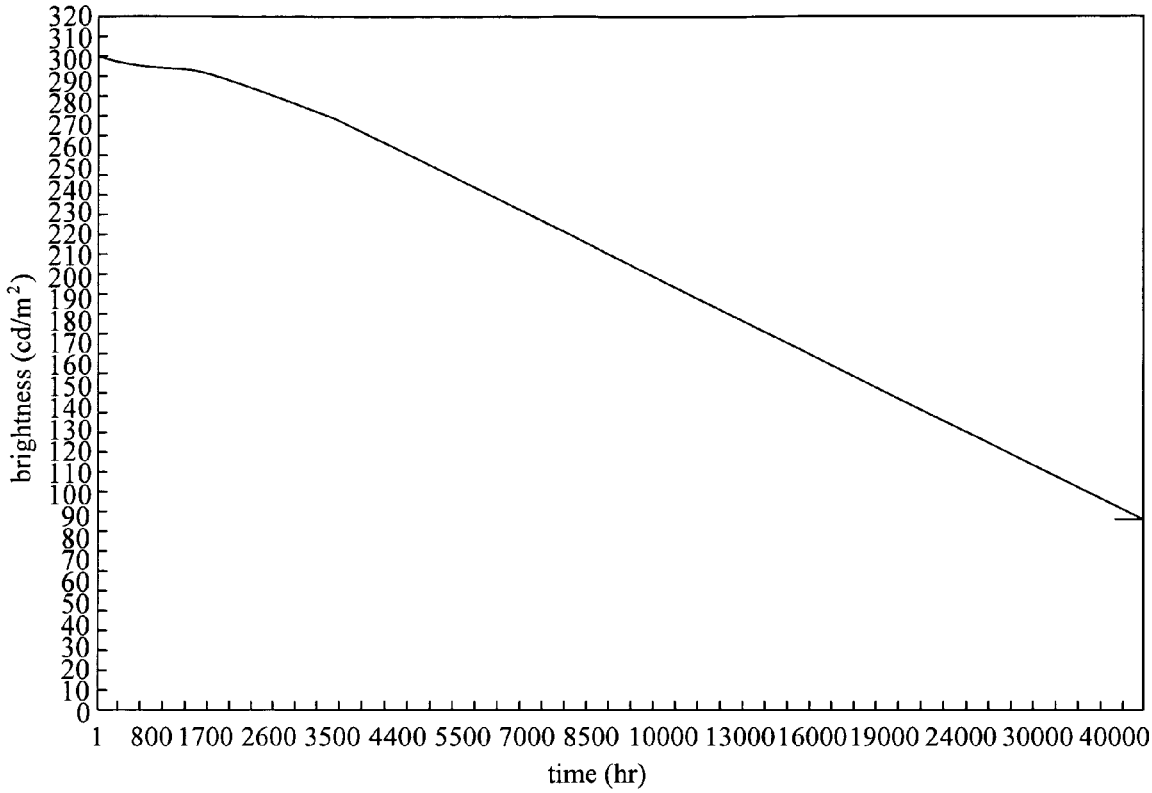
FIG. 1 (prior art)
FIG. 1 is a diagram illustrating the relationship between the brightness of a conventional display system and time.
Figure 2:
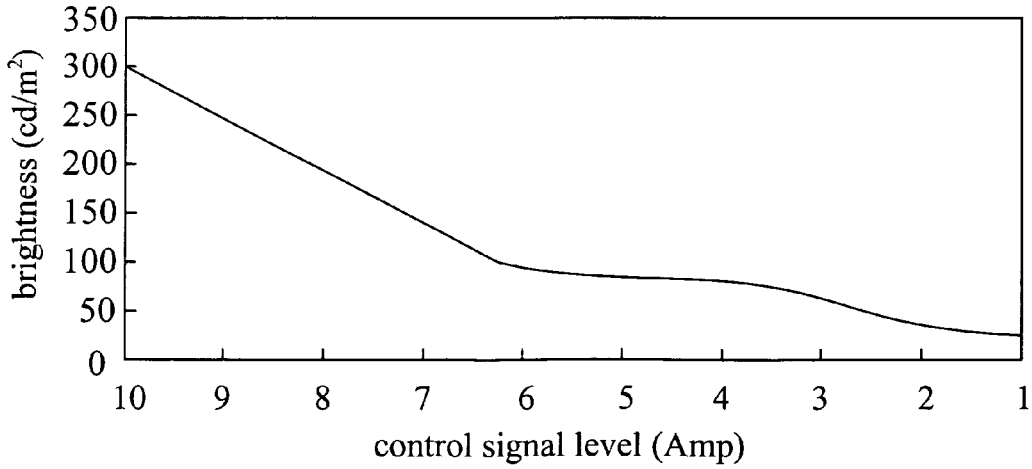
FIG. 2 (prior art)
FIG. 2 is a diagram illustrating the relationship between the brightness of the conventional display system and the control signal levels.
Figure 3:
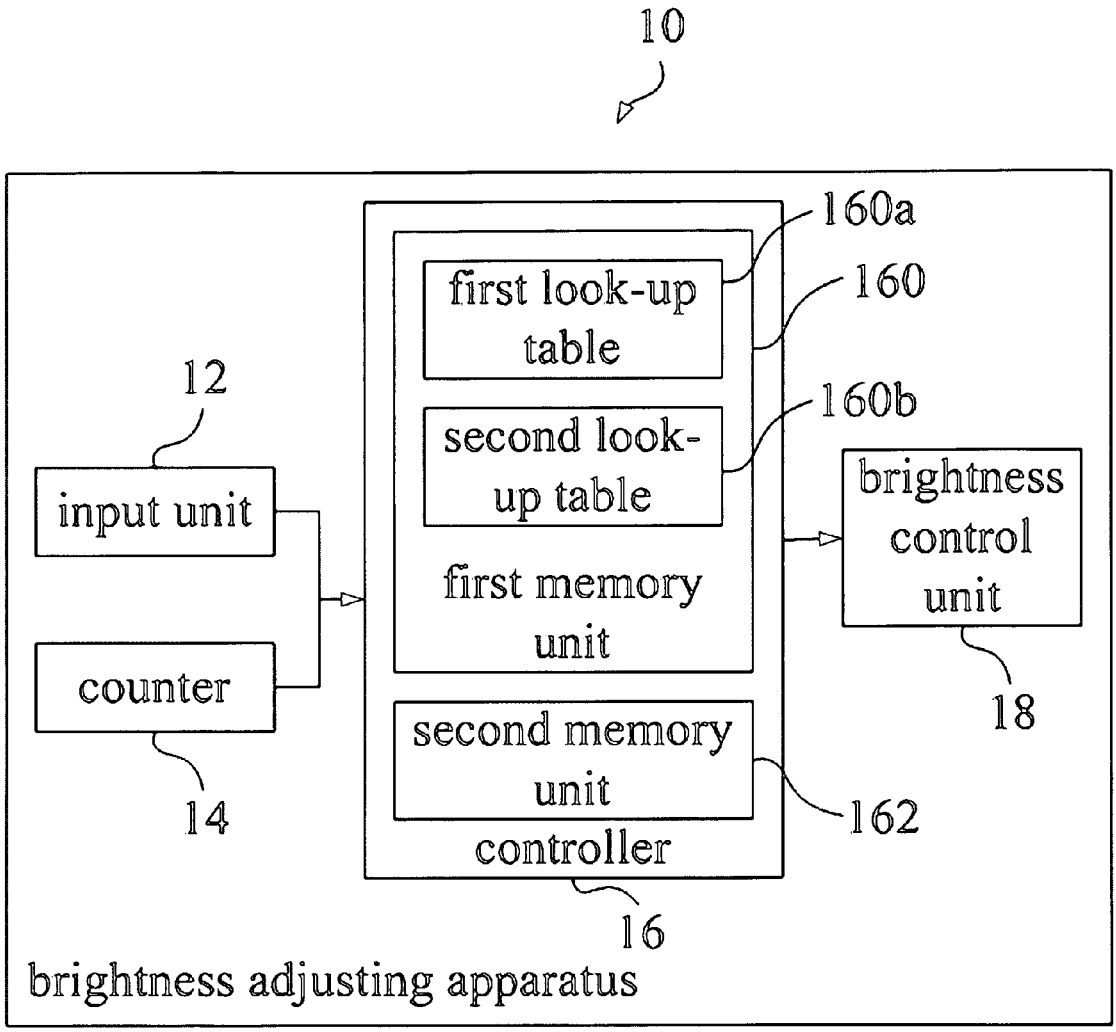
FIG. 3 is a functional block diagram illustrating a brightness adjusting apparatus according to a first preferred embodiment of the invention.

Referring to FIG. 3, FIG. 3 is a functional block diagram illustrating a brightness adjusting apparatus 10 according to a first preferred embodiment of the invention. In a display system (not shown), the apparatus 10 is used for adjusting the brightness of an inputted video sequence. The display system can be a liquid crystal display (LCD) or the like. At a first time, the inputted video sequence is displayed with an initial brightness corresponding to a present control signal level. Then, at a second time after the first time, before the invention is applied to the display system, the brightness will decay with time. In other words, the inputted video sequence is displayed with a decayed brightness. As shown in FIG. 3, the apparatus 10 comprises an input unit 12, a counter 14, a controller 16, and a brightness control unit 18. The counter 14 is used for counting time. The controller 16 is respectively coupled to the input unit 12 and the counter 14, and comprises a first memory unit 160 and a second memory unit 162. The first memory unit 160 is used for storing a first look-up table 160*a* and a second look-up table 160*b*. The second memory unit 162 is used for recording the initial brightness. The brightness control unit 18 is coupled to the controller 16.

Referring to FIGS. 4 and 5, FIG. 4 is a schematic diagram illustrating the first look-up table 160*a* shown in FIG. 3. FIG. 5 is a schematic diagram illustrating the second look-up table 160*b* shown in FIG. 3. The first look-up table 160*a* comprises M time, N control signal levels, and M*N brightness. Each of the M*N brightness is respectively corresponding to one of the M time and one of the N control signal levels, wherein M and N both are a natural number, respectively. The control signal level can be a current signal, a voltage signal, or a pulse width modulation (PWM) signal. In this embodiment, the first look-up table 160*a* comprises 5 time (T), 5 control signal levels (CSL), and 25 corresponding brightness (BR), and the control signal level is designed as a current signal, as shown in FIG. 4. The second look-up table 160*b* comprises a plurality of sub look-up tables, and each of the sub look-up tables further comprises an initial brightness corresponding to at least one decayed brightness and at least one compensating parameter. In this embodiment, the second look-up tables 160*b* comprises 5 sub look-up tables, and each of the sub look-up tables further comprises one initial brightness (IBR) corresponding to 5 decayed brightness (DBR) and 5 compensating parameters (CP), as shown in FIG. 5. The first look-up table 160*a* and the second look-up table 160*b* can be designed based on practical application.

According to the aforementioned preferred embodiment, when a user inputs a present control signal level (4 Amp) by the input unit 12 at a first time ($T_1$), the display system will display the inputted video sequence by an initial brightness (100 cd/m$^2$) corresponding to the present control signal level (4 Amp). The initial brightness (100 cd/m$^2$) is recorded in the second memory unit 162. When the display system is used from the first time ($T_1$) to a second time ($T_2$), since the brightness decays with time, and the display system displays the inputted video sequence by a decayed brightness (50 cd/m$^2$). At this time, the counter 14 will output a notification signal to notify the controller 16 of the brightness should be adjusted. When the controller 16 receives the present control signal level (4 Amp) and the notification signal, the controller 16 will further determine the initial brightness (100 cd/m$^2$) and the decayed brightness (50 cd/m$^2$) according to the first look-up table 160*a*, the present control signal level (4 Amp), the first time ($T_1$), and the second time ($T_2$). Afterward, according to the second look-up table 160*b*, the initial brightness (100 cd/m$^2$), and the decayed brightness (50 cd/m$^2$), the controller 16 will determine a present compensating parameter (CP=2 Amp). After the brightness control unit 18 receives the present compensating parameter (CP=2 Amp), the brightness control unit 18 will add up the present compensating parameter (CP=2 Amp) and the present control signal level (4 Amp), so as to generate an adjusted control signal level (6 Amp). At the second time ($T_2$), the control signal level 6 Amp is corresponding to the brightness 100 cd/m$^2$, i.e. the initial brightness set at the first time ($T_1$), as shown in FIG. 4. Accordingly, the brightness control unit 18 will utilize the adjusted control signal level (6 Amp) to adjust the brightness of the inputted video sequence from the decayed brightness (50 cd/m$^2$) to the initial brightness (100 cd/m$^2$). In other words, according to the apparatus of the invention, at the second time ($T_2$), the display system will still display the inputted video sequence by the brightness (100 cd/m$^2$) set at the first time ($T_1$) even though the brightness of the display system will decay with time.

Furthermore, when the display system is used for a span of time, the user can also change the brightness of the inputted video sequence as he/she wishes. As the embodiment mentioned in the above, when it's at the second time ($T_2$), the display system will display the inputted video sequence by the brightness of 100 cd/m$^2$ corresponding to the control signal level 6 Amp. At this time ($T_2$), the user can adjust the brightness of the inputted video sequence to be 125 cd/m$^2$, and then the corresponding control signal level will be 8 Amp, as shown in FIG. 4. At the same time, the initial brightness recorded in the second memory unit 162 will also be changed from 100 cd/m$^2$ to 125 cd/m$^2$. When the display system keeps being used from the second time ($T_2$) to a third time ($T_3$), since the brightness further decays with time, and the display system displays the inputted video sequence by a decayed brightness (100 cd/m$^2$). At this time, the counter 14 will output a notification signal to notify the controller 16 of the brightness should be adjusted. When the controller 16 receives the present control signal level (8 Amp) and the notification signal, the controller 16 will further determine the initial brightness (125 cd/m$^2$) and the decayed brightness (100 cd/m$^2$) according to the first look-up table 160*a*, the present control signal level (8 Amp), the second time ($T_2$), and the third time ($T_3$). Afterward, according to the second look-up table 160*b*, the initial brightness (125 cd/m$^2$), and the decayed brightness (100 cd/m$^2$), the controller 16 will determine a present compensating parameter (CP=2 Amp). After the brightness control unit 18 receives the present compensating parameter (CP=2 Amp), the brightness control unit 18 will add up the present compensating parameter (CP=2 Amp) and the present control signal level (8 Amp), so as to generate an adjusted control signal level (10 Amp). At the third time ($T_3$), the control signal level 10 Amp is corresponding to the brightness 125 cd/m$^2$, i.e. the initial brightness set at the second time ($T_2$), as shown in FIG. 4. Accordingly, the brightness control unit 18 will utilize the adjusted control signal level (10 Amp) to adjust the brightness of the inputted video sequence from the decayed brightness (100 cd/m$^2$) to the initial brightness (125 cd/m$^2$). In other words, according to the apparatus of the invention, at the third time ($T_3$), the display system will still display the inputted video sequence by the brightness (125 cd/m$^2$) set at the second time ($T_2$) even though the brightness of the display system will decay with time.

In another preferred embodiment of the invention, the second memory unit 162 and the first memory unit 160 are the same memory unit.

Figure 6:
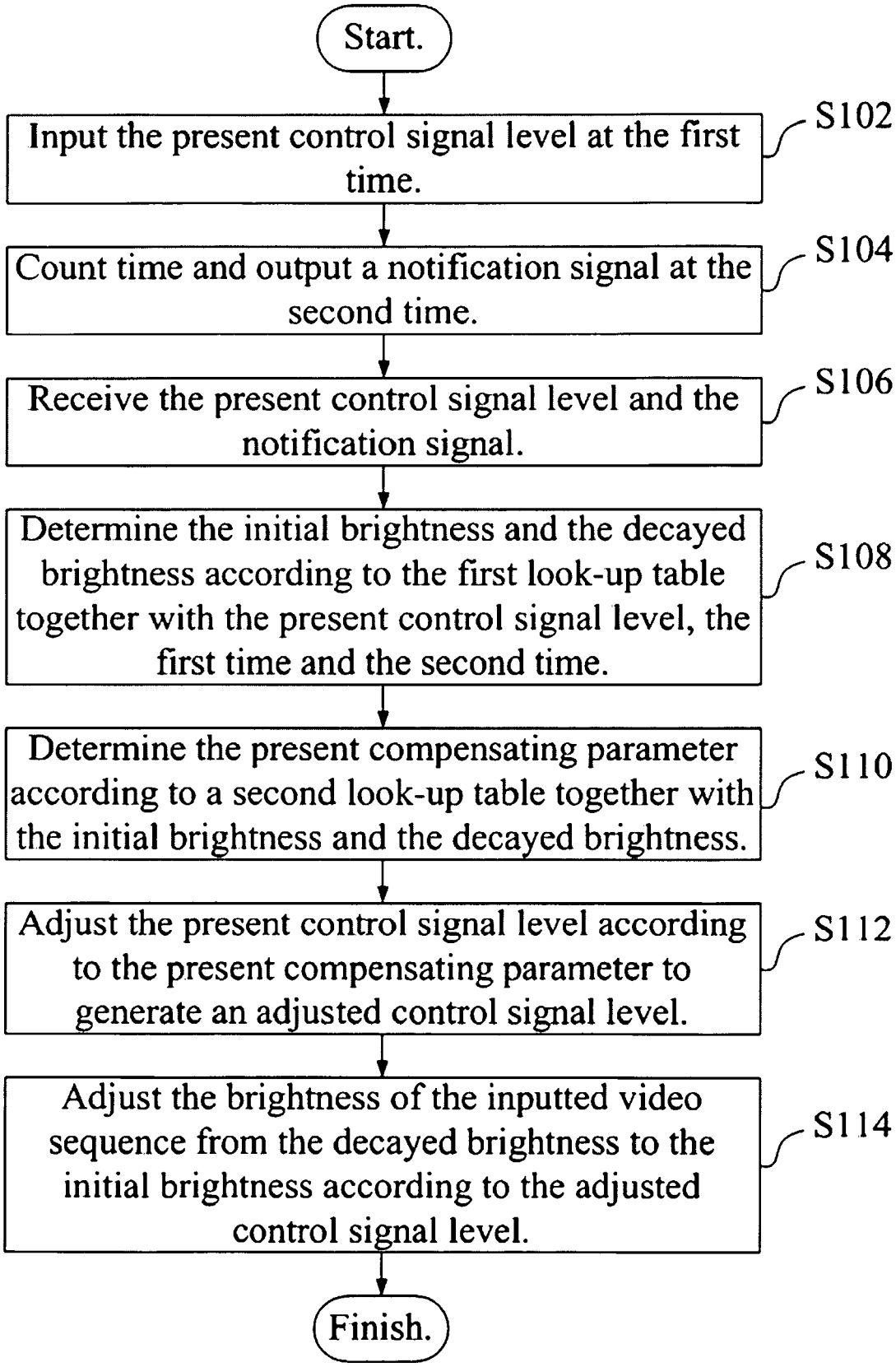
FIG. 6 is a flowchart showing a brightness adjusting method according to the first preferred embodiment of the invention.

Referring to FIG. 6, FIG. 6 is a flowchart showing a brightness adjusting method according to the first preferred embodiment of the invention. In a display system, the method of the invention is used for adjusting the brightness of an inputted video sequence. At a first time, the inputted video sequence is displayed with an initial brightness corresponding to a present control signal level. Then, at a second time after the first time, the inputted video sequence is displayed with a decayed brightness. According to the aforementioned first preferred embodiment, the method of the invention comprises the following steps. At start, step S102 is performed to input the present control signal level at the first time. Afterward, step S104 is performed to count time and output a notification signal at the second time. Step S106 is then performed to receive the present control signal level and the notification signal. Step S108 is then performed to determine the initial brightness and the decayed brightness according to the first look-up table together with the present control signal level, the first time and the second time. Step S110 is then performed to determine the present compensating parameter according to a second look-up table together with the initial brightness and the decayed brightness. Step S112 is then performed to receive the present compensating parameter and adjust the present control signal level according to the present compensating parameter to generate an adjusted control signal level. Finally, step S114 is performed to adjust the brightness of the inputted video sequence from the decayed brightness to the initial brightness according to the adjusted control signal level.

Compared to the prior art, according to the apparatus and the method thereof of the invention, when the display system is used for a predetermined span of time, the controller will automatically adjust the control signal level to adjust the brightness of the inputted video sequence from the decayed brightness to the original brightness set by the user. Accordingly, the brightness of the display system can be maintained by simple control without any sensor, and then the cost will be reduced. With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An apparatus for adjusting brightness of an inputted video sequence, the inputted video sequence being displayed with an initial brightness at a first time and corresponding to a present control signal level, and, before adjustment, the inputted video sequence being displayed with a decayed brightness at a second time after the first time, the apparatus comprising:

an input unit for inputting the present control signal level;

a counter for counting time and outputting a notification signal at the second time;

a controller, respectively coupled to the input unit and the counter, for receiving the present control signal level and the notification signal, the controller comprising:

a first memory unit for storing a first look-up table and a second look-up table, the controller, according to the first look-up table together with the present control signal level, the first time and the second time, determining the initial brightness and the decayed brightness, and, according to the second look-up table together with the initial brightness and the decayed brightness, generating a present compensating parameter, the first look-up table comprising:

M time, the first time and the second time being respectively selected from one of the M time, M being a natural number;

N control signal levels, the present control signal level being selected from one of the N control signal levels, N being a natural number; and M*N brightness, each of the M*N brightness being respectively corresponding to one of the M time and one of the N control signal levels; and a brightness control unit, coupled to the controller, for receiving the present compensating parameter, adjusting the present control signal level according to the present compensating parameter, and generating an adjusted control signal level to adjust the brightness of the inputted video sequence at the second time from the decayed brightness to the initial brightness.

2. The apparatus of claim 1, wherein the second look-up table comprises a plurality of sub look-up tables, and each of the sub look-up tables further comprises an initial brightness corresponding to at least one decayed brightness and at least one compensating parameter.

3. The apparatus of claim 1, wherein in the first look-up table, the brightness corresponding to the second time and the adjusted control signal level is equal to the initial brightness corresponding to the first time and the present control signal level.

4. The apparatus of claim 1, wherein the controller further comprises a second memory unit for recording the initial brightness.

5. The apparatus of claim 4, wherein the second memory unit and the first memory unit are the same memory unit.

6. The apparatus of claim 1, wherein the adjusted control signal level is obtained by adding up the present compensating parameter and the present control signal level.

7. A method for adjusting brightness of an inputted video sequence, the inputted video sequence being displayed with an initial brightness corresponding to a first time and a present control signal level, and, before adjustment, the inputted video sequence being displayed with a decayed brightness corresponding to a second time after the first time, the method comprising steps of:

(a) inputting the present control signal level at the first time;

(b) counting time and outputting a notification signal at the second time;

(c) receiving the present control signal level and the notification signal, determining the initial brightness and the decayed brightness according to a first look-up table together with the present control signal level, the first time, and the second time, and generating a present compensating parameter according to a second look-up table together with the initial brightness and the decayed brightness, wherein the first look-up table comprises:

M time, the first time and the second time being respectively selected from one of the M time, M being a natural number;

N control signal levels, the present control signal level being selected from one of the N control signal levels, N being a natural number; and M*N brightness, each of the M*N brightness being respectively corresponding to one of the M time and one of the N control signal levels;

(d) receiving the present compensating parameter and adjusting the present control signal level according to the present compensating parameter to generate an adjusted control signal level; and (e) adjusting the brightness of the inputted video sequence from the decayed brightness to the initial brightness according to the adjusted control signal level.

8. The method of claim 7, wherein the second look-up table comprises a plurality of sub look-up tables, and each of the sub look-up tables further comprises an initial brightness corresponding to at least one decayed brightness and at least one compensating parameter.

9. The method of claim 7, wherein in the first look-up table, the brightness corresponding to the second time and the adjusted control signal level is equal to the initial brightness corresponding to the first time and the present control signal level.

10. The method of claim 7, wherein the adjusted control signal level in step (d) is obtained by adding up the present compensating parameter and the present control signal level.

* * * * *

UNITED STATES PATENT AND TRADEMARK OFFICE

CERTIFICATE OF CORRECTION

PATENT NO. : 7,626,566 B2
APPLICATION NO. : 11/416329
DATED : December 1, 2009
INVENTOR(S) : Chi-Pao Huang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 857 days.

Signed and Sealed this

Twenty-first Day of December, 2010

David J. Kappos

David J. Kappos
*Director of the United States Patent and Trademark Office*